United States Patent [19]

Zoell

[11] Patent Number: 4,751,759

[45] Date of Patent: Jun. 21, 1988

[54] SURFACE CLEANING APPLIANCE

[76] Inventor: Dieter Zoell, Zelgliweg 5, 2545 Selzach, Switzerland

[21] Appl. No.: 937,555

[22] Filed: Dec. 3, 1986

[30] Foreign Application Priority Data

Apr. 11, 1985 [CH] Switzerland ..... 1549/85
Aug. 12, 1985 [CH] Switzerland ..... 3454/85
Apr. 11, 1986 [WO] PCT Int'l Appl... PCT/CH86/00045

[51] Int. Cl.[4] ..... A47L 5/14
[52] U.S. Cl. ..... 15/1.5 R; 15/345; 15/398
[58] Field of Search ..... 15/345, 346, 398, 1.5 R, 15/1.5 A, 405

[56] References Cited

U.S. PATENT DOCUMENTS 2,181,487 11/1939 Khuen-Kryk ..... 15/345
4,198,061 4/1980 Dunn ..... 15/1.5 R
4,364,147 12/1982 Biedermann et al. ..... 15/405 X
4,454,621 6/1984 Testone ..... 15/1.5 R

FOREIGN PATENT DOCUMENTS 249345 2/1948 Switzerland ..... 15/346

*Primary Examiner*—Chris K. Moore
*Attorney, Agent, or Firm*—Abelman Frayne Rezac & Schwab

[57] ABSTRACT

The appliance is intended to remove dust from solid objects and comprises an ionization device (7) which is operatively associated with an incorporated air nozzle (1), which has an obliquely arranged, narrow, linear blowing slot (2) which serves to produce an air jet which sweeps over the surface to be cleaned at high velocity. The ionization device (7) produces positive as well as negative ions in the laminar air jet in order to neutralize the electrostatically-charged dust particles. An air suction nozzle (3) with a corresponding suction slot (4) is arranged at a short distance from the blowing slot (2) and is operatively associated with a flat brush (5) projecting from the appliance, which serves as a baffle, determining the distance of the appliance from the surface to be cleaned, limiting the gap enclosing the laminar air jet and, to a large extent preventing sucking-in of the surrounding air. This arrangement is designed as a portable and industrial cleaning appliance.

4 Claims, 2 Drawing Sheets

1
2
3
4
5
7
9
10
11
12
13
14
15
16
17
18
H
X

SURFACE CLEANING APPLIANCE

The invention relates to a surface cleaning appliance for the removal of dust from solid objects, in particular for the preliminary cleaning of surfaces prior to painting.

Despite intensive preliminary cleaning and dust removal prior to the industrial painting of objects, surface paint layers are frequently found to have inclusions of dust particles which necessitate considerable follow-up work. Such fouling is essentially due to inadequate cleaning. The currently used manual method for the removal of dust prior to the painting process is conducted in two stages: Dust is blown off the surface to be cleaned using compressed air at ca. 5 bar and the surface is then rubbed down with dust-binding and/or damp cloths or special gloves. In so doing, on the one hand, as a result of the high air pressure, dust particles are whirled up and thereby settle once again on the cleaned areas. It is consequently senseless to blow dust off surfaces above a certain size with compressed air. Manual cleaning, on the other hand, provides no guarantee that all areas of the surface to be cleaned are treated. Through constant wiping of the surfaces and the resultant friction, an electrostatic charge is moreover created which causes the dust particles to adhere to the surfaces. A further disadvantage is that the cleaning staff cannot perceive the dust particles which are present, due to the colour of the undercoat, the primer or the filler.

U.S. Pat. No. 4,454,621 describes a cleaning apparatus with means for blowing ionized air and for sucking away neutralized particles which is specially designed for the continuous cleaning of both sides of bands or webs. The arrangement described is, however, not suitable for the cleaning of solid objects of various shapes and dimensions such as, for example, motor vehicle bodies.

The object of the invention is to provide a surface cleaning appliance which permits the rapid, thorough removal of dust from various solid objects with little effort and which largely overcomes the above-described disadvantages. This object is achieved by a surface cleaning appliance having the characteristics set out in the claims.

The surface cleaning appliance according to the instant invention essentially comprises an air blowing nozzle having a narrow, obliquely arranged linear blowing slot, which is operatively associated with an ionizing device, an air suction nozzle having a linear suction slot and with a baffle in such a manner that it emits a thin, flat laminar jet of air at high velocity which sweeps intensively over the surface to be cleaned and is then sucked up through the linear suction slot.

The surface cleaning appliance is provided according to the instant invention with a baffle which serves to provide contact with the surface to be cleaned and to maintain the appliance at a distance therefrom, while it advantageously consists of a flat protective brush and is operatively associated with the linear suction slot so that it largely prevents sucking in of the surrounding air while it defines the laminar jet of air so that it is sucked up through the suction slot after sweeping over the surface to be cleaned.

This brush is preferably a toothed strip brush and fulfills various functions in accordance with the invention: firstly it serves as a baffle and distance piece or spacer in order to define and delimit the laminar air jet and to thereby achieve an optimal cleaning effect while to a large extent avoiding the sucking up of surrounding air. Secondly, it serves as a protective brush to avoid any damage to the surface to be cleaned or to the appliance. Furthermore, by means of this brush, adhering and moist dust may be mechanically detached from the surface to be cleaned and then sucked up.

In order to ensure the delivery of a laminar jet of air, the air blowing nozzle is dimensioned, adapted to the desired air speed and advantageously provided with inner guide surfaces so that the air jet is evenly distributed and directed obliquely so that no turbulence is created in the air jet. By means of an air blowing slot having a very narrow aperture, which generally amounts to less than 1 mm and preferably less than 0.5 mm and, for example, 0.2 to 0.3 mm, the air stream may be directed through the linear blowing slot in the form of a flat, very thin, laminar jet of air over the entire length of the slot at a slight overpressure of less than 1 bar, preferably below 0.5 bar, with a relatively short jet length and be delivered at an oblique angle to the surface to be cleaned in order to ensure a laminar flow along this surface. The blowing air may be produced in a ring compressor located outside the cleaning appliance and fed to the blowing air nozzle via a low pressure hose, while the suction air is conducted from the air suction nozzle by means of a suction hose.

The length and shape of the suction slot are, on the other hand, adapted to the air blowing slot and arranged that the air suction nozzle is able to suck away a somewhat larger amount of suction air than the amount of the air jet delivered, without appreciable loss of pressure. The suction air is advantageously delivered to a high performance filter, whereby cleaned air is supplied to the suction side of the compressor and delivered thereby to the air blowing nozzle.

The shape and dimensions of the blowing slot and of the suction slot are in each case adjusted to one another and may be adapted to the nature of the cleaning work required. For this purpose, on the one hand, the air blowing nozzle and the air suction nozzle may be equipped with various extension attachments. On the other hand they may also be provided with means for adjusting the length of the blowing slot and of the suction slot, whereby these slots may be adjusted individually or jointly, by hand or using a motor. An adjustable slot width may, furthermore, be achieved for the blowing slot or for the suction slot through the incorporation of appropriate adjusting means, while means for the mechanical fine adjustment of the slot width may be provided.

The special combination in accordance with the invention of a blowing nozzle having an obliquely disposed, narrow linear blowing slot operatively associated with an ionising device for the delivery of a uniform, ionized laminar jet of air, with a suction nozzle having an appropriate suction slot and with a baffle, thus provides highly effective, rapid and thorough cleaning by means of the precisely defined flat, ionized laminar air jet which is precisely defined and limited by the appliance, the blowing slot, the suction slot, the baffle and the surface to be cleaned, and which vigorously sweeps over, and cleans, this surface at high velocity and with minimal creation of turbulence and sucking-in of surrounding air.

The cleaning appliance according to the invention is passed by hand or mechanically along the contours of the object to be cleaned. By means of the laminar, ionized jet of air, dust particles adhering to the surface are detached and blown to the suction slot, while practically no turbulence is caused by this action, and the detached dust particles are immediately taken up and removed by the suction slot. In so doing, the appliance is guided so that the brush is always kept in contact with the surface to be cleaned in order to fulfil its designated special functions as baffle to maintain distance and to limit the laminar flow and the sucking away of air from the cleaning gap, whereby adhering and moist dust may be caught up by the brush, mechanically detached and sucked away.

The invention will now be described hereinafter with refernce to examples of embodiments and to the appended drawings.

Figure 1:
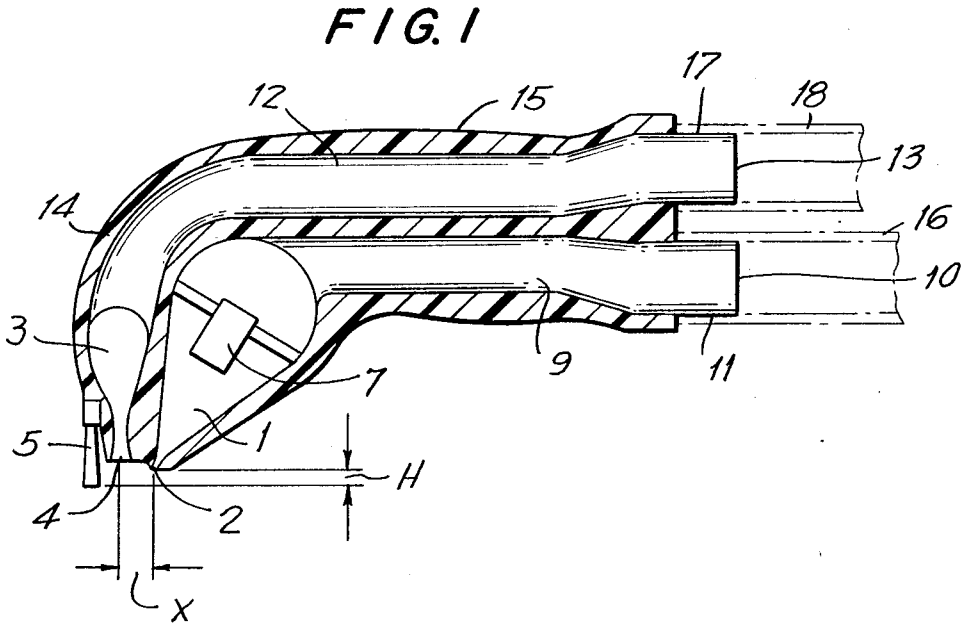
FIG. 1 shows a schematic section through a median plane of a portable surface cleaning appliance according to the invetnion.

The portable cleaning appliance of FIG. 1 comprises a housing 14 having a handle 15 for carrying and guiding the appliance, an incorporated blowing air nozzle 1 with an obliquely arranged linear blowing slot 2 on the underside of the appliance, an ionizing device 7 also built into the appliance and operatively associated with the air blowing nozzle 1, a suction nozzle 3 having a suction slot 4 which is disposed at a short distance X from the blowing slot 2 on the underside of the appliance and a flat brush 5, preferably a toothed strip brush, which is disposed next to the suction slot 4 and projects from the underside of the appliance at a heigh H in relation to the outlet of the blowing slot 2. The brush 5 is fixed to the appliance by suitable means, not shown in further detail, which make it possible for it to be replace and for its height H to be adjusted as required.

The air blowing nozzle 1 is connected to an incorporated air blowing duct 9 having an inlet 10 with a projecting part 11 for connection to a blowing air hose 16, indicated in broken lines, which serves to supply low pressure air. The suction nozzle 3 is further linked to an incorporated suction air duct 12 having an outlet 13 with a projecting end-piece 17 for connection to a suction air hose 18 indicated in broken lines, which serves to suck up the cleaning air at an adequate vacuum.

The air blowing nozzle 1 and the blowing slot 2 are so dimensioned and designed that a flat, laminar jet of air is delivered at high speed through the blowing slot 2. As may be seen in FIG. 1, the blowing slot 2 is obliquely disposed with respect to the suction slot 4 and to the underside of the appliance so as to be able to direct a laminar jet of air at a small, acute angle onto the surface to be cleaned, which is in contact with the lower, free end of the brush 5 at the height H and will limit the cleanign gap parallel to the underside of the appliance.

The mode of operation of the described portable cleaning appliance as shown in FIG. 1 may be explained as follows:

In use, the portable cleaning appliance is held by the handle 15 and guided along the surface to be cleaned in such a way that the free end of the brush 5 is always maintained in contact with said surface. In so doing, the brush 5 shall be held perpendicular to said surface so that the underside of the appliance is parallel to the surface to be cleaned. The height H of the brush 5 thus determines the desired distance between the underside of the portable appliance and the surface to be cleaned and defines therewith an narrow cleaning gap which encloses the laminar jet of air delivered by the blowing slot 2. The air jet may thereby be maintained with a laminar flow of high velocity along the surface to be cleaned through the cleaning gap, while the brush 5 laterally limits this cleaning gap, determines the width of this gap and largely prevents an undersirable sucking-in of surrounding air. This high-speed laminar jet can thus vigorously sweep over the surface to be cleaned, detach and carry along dust particles present thereon, then be immediately caught by suction and sucked up with the detached dust particles. The incorporated ionizing device 7 makes it possible to continuously generate positive or negative ions in the blowing air jet. Electrostatically charged particles located on the surface to be cleaned may thus be neutralized, detached and removed by means of the ionized blowing air jet.

The air blowing nozzle and the suction nozzle of the portable cleaning appliance of the invention may be of variable width and may be operated by appropriate mechanical adjusting means, e.g. with the aid of articulated arms and a gear drive either by hand or with a motor in order to adjust the width of both nozzles individually or together as required. The blowing slot and the suction slot of these nozzles may, moreover, be equipped with adjustable guide lips or other suitable means in order to vary their gap width as required. For this purpose mechanical fine adjustment of the gap width may be possibly provided. Moreover, additional brushes may be provided on the cleaning appliance in order, for example, to laterally limit the laminar flow of the jet of air so as to prevent surrounding air from being sucked in from the side.

In addition, the portable cleaning appliance of the invention may be fitted with sensors and display means in order, for example, to permit a display of the counter-pressure on the brush, a display of air pressure for the purpose of optimizing the blowing air - suction air balance or a display of the positive or negative charge on the surface.

Various materials may be used in the manufacture of the cleaning appliance of the invention. For this purpose various plastic materials may advantageously be used in order, inter alia, to make the appliance as lightweight as possible. Moreover, various parts of the appliance may be manufactured from any suitable metal.

The portable cleaning appliance of the invention possesses many advantages, for example, it is simple to handle, has many possible uses with relatively low purchasing costs, minimum weight and very little space requirements. Moreover it appreciably simplifies and saves the effort involved in cleaning work, whilst avoiding the already mentioned follow-up work durign painting. At the same time, it imposes no burden on the environment.

Figure 2:
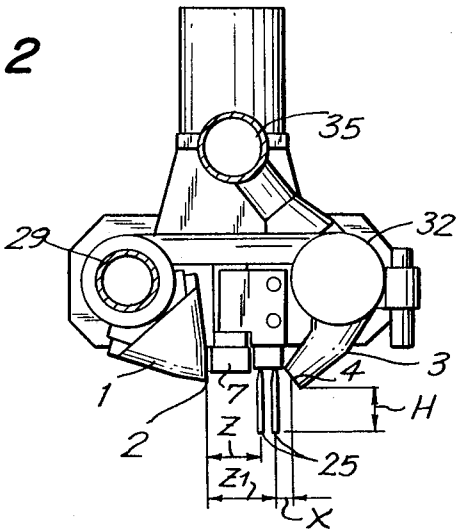
FIG. 2 shows a schematic section through a median plane of an individual surface cleaning appliance according to the invention.
Figure 3:
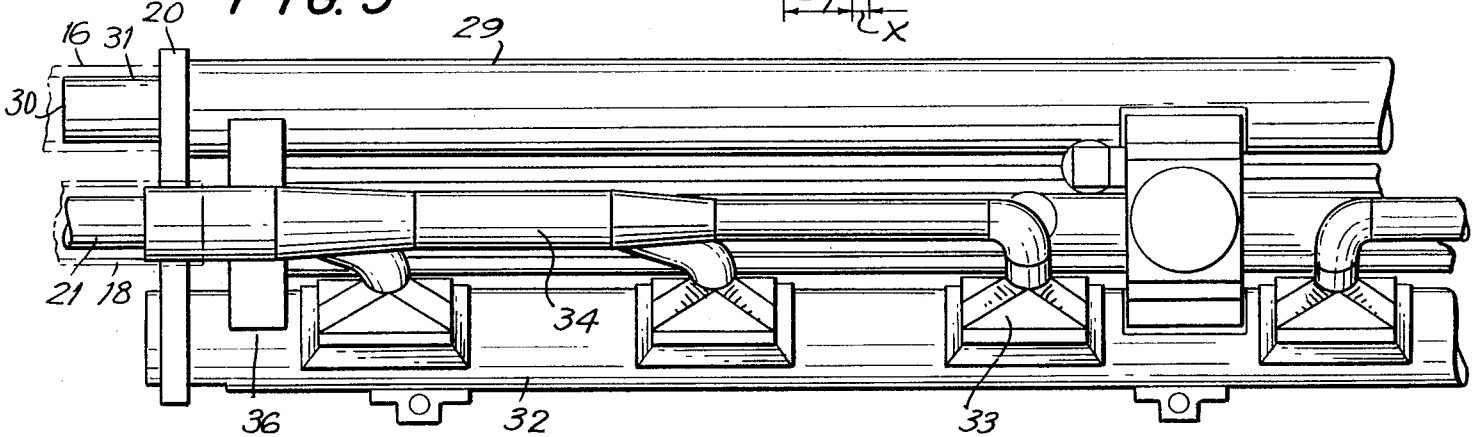
FIG. 3 shows a schematic partial plan view of the industrial cleaning appliance of FIG. 2.

The industrial surface cleaning appliance according to FIGS. 2 and 3 comprises a connection 20 with a take-up center 21 for mounting and revolving the appliance. The industrial cleaning appliance shown in FIG. 2 comprises an incorporated air blowing nozzle 1 with an obliquely disposed blowing slot on the underside of the appliance, an ionizing device 7, which is operatively associated with the air blowing nozzle 1, a two-part toothed strip brush 25 disposed at a distance Z and $Z_1$ from the blowing air nozzle, 1, divided and offset in the middle and an obliquely disposed air suction nozzle 3 having a suction slot 4 which is located at a short distance X from the strip brush 25, which projects in front of the air suction nozzle 3 from the underside of the appliance at a height H in relation to the entry edge of the suction slot 4 and the underside of the appliance. The strip brush 25 is fixed to the appliance by means of appropriate means, not shown in further detail, which make it possible, on the one hand to impart thereto an oscillating movement and, on the other hand, to replace them and to adjust their height H as required.

The air blowing nozzle is linked to an incorporated air blowing duct 29 having an inlet 30 with a projecting part 31 for connection to an air blowing hose 16, shown in broken lines, which serves to supply compressed air. The suction nozzle is, in addition, linked to an incorporated suction air duct 32 which is linked to the connection pieces 33 leading to a central tube 34. This tube 34 has an outlet 35 with a projecting end-piece 36 for connection to a suction air hose 18, shown in broken lines, which serves to suck up the cleaning air with an adapted vacuum.

The air blowing nozzle 1 and the blowing slot 2 are so dimensioned and designed that a flat, laminar jet of air is delivered through the blowing slot 2 at high velocity, corresponding pressure and appropriate range. As shown in FIG. 2, the blowing slot 2 is disposed obliquely so that it can direct the laminar jet of air at the appropriate acute angle herefor onto the surface to be cleaned.

The mode of operation of the industrial cleaning appliance shown in FIGS. 2 and 3 may be described as follows:

The industrial cleaning appliance is swivel-mounted for use on the pick-up centers 20 on the right and left of the machine and guided by means of control elements to follow the surface to be cleaned in such a way that the free end of the strip brush 25 is always maintained in contact with this surface. The height H of the strip brush 25 thus determines the desired distance between the underside of the industrial cleaning appliance and the surface to be cleaned and limits therewith the cleaning gap which encloses the laminar jet of air given off by the blowing slot 2. This makes it possible to maintain the jet of air with a laminar flow of high velocity along the surface to be cleaned through the cleaning gap, while the strip brush 25 limits this gap, determines its clearance and prevents an undesirable, premature sucking up of the laminar jet of air. The laminar flow with corresponding velocity can thus vigorously sweep over the surface to be cleaned, detach dust particles thereon and collect and be sucked off through the strip brush 25 together with the dust particles. The ionizing device 7 continuously produces ions in the laminar jet of air so that electrostatically charged particles present on the surface to be cleaned may be neutralized, detached and removed by the jet of air.

The blowing slot of the blowing nozzle and the suction slot of the suction nozzle may, in addition, be equipped with adjustable guide lips in order to vary their clearance as required. For this purpose it is possible to provide a mechanical fine adjustment of the slot clearance. The ionizing device operatively associated with the blowing air nozzle may be mounted at or in the blowing air nozzle in order to achieve adequate ionization when little space is available.

In addition, the industrial surface cleaning appliance may be equipped with additional strip brushes in order, for example, to completely limit the laminar flow of the jet of air laterally and to prevent sucking in surrounding air from all sides.

In addition, the industrial surface cleaning appliance of the invention may be fitted with sensors and display means in order, for example, to permit display of th counterpressure on the brush, an indication of air pressure in order to optimize th blowing air - suction air balance or the display of the positive or negative charge on the surface.

The industrial surface cleaning appliance according to the invention has various advantages. For example it is suited, for mechanical or automated handling, can cover a precisely defined surface sweeping area, has manifold possible applications in automatic production cycles prior to further processing of the products, is environmentally harmless, provides safety at the workplace, presents the possibility of incorporation into existing production lines and may be used as an independently operating system.

The obliquely disposed linear blowing slot of the blowing air nozzle according to the invention is directed at an acute angle of position of, for example 25° to 60° on the surface to be cleaned so that the laminar flow of the jet of air given off from the flowing slot may be ensured on the surface to be cleaned. For this purpose the blowing slot is disposed at an appropriate angle with the underside of the appliance and with the median plane of the suction slot and is appropriately dimensioned. The laminar flow is, moreover, ensured by the height of the baffle, or the strip brush which limits between the blowing slot and the underside of the appliance and the surface to be cleaned a cleaning slot gap that is as narrow as possible. The gap clearance and the distance of the blowing slot outlet from the surface to be cleaned is maintained by the baffle or the brush and is advantageously at least 2 mm in order to prevent the appliance coming into contact with this surface. This distance is advantageously 5 to 10 mm, while it may if necessary be increased to 20 to 30 mm.

I claim:

1. Surface cleaning appliance for the removal of dust from solid objects, in particular for pre-cleaning surfaces prior to painting, the apparatus including an ionizing device operatively associated with an air blowing nozzle and including a suction air nozzle, characterized in that:

(a) the air blowing nozzle (1) is provided with a narrow, linear blowing slot (2) which is obliquely disposed and is so arranged that it can deliver a flat, laminar jet of air at an angle to a surface to be cleaned;

(b) the ionizing device (7) is associated with this air blowing nozzle (1) in such a way that it creates in the flat laminar jet of air given off by the blowing slot (2) ions for the neutralization of electrostatically charged dust particles;

(c) the air suction nozzle (3) is provided with a suction slot (4) which corresponds to the blowing slot (2) and is disposed at a short distance (X) in front of the blowing slot (2) in such a way that the laminar jet of air can vigorously sweep over the surface to be cleaned with a laminar flow of high velocity in order to detach dust particles present thereon and to then suck these in through the suction slot (4) of the suction air nozzle (3) and (d) at least one baffle (5, 25) is provided and operatively associated with the suction slot (4), projects in relation thereto with a predetermined small height (H) from the appliance and serve to maintain a desired distance between the appliance and the surface to be cleaned in order to thereby define therewith a short, narrow gap for the said laminar jet of air and to thereby substantially prevent the sucking in of surrounding air.

2. Surface cleaning appliance according to claim 1, characterized in that the baffle is fitted to the appliance in the form of a flat brush (5, 25) of adjustable height.

3. Surface cleaning appliance according to claim 1, characterized in that the ionizing device (7) is arranged for operation with direct current in order to produce positive or negative ions continuously in the laminar jet of air.

4. Surface cleaning appliance according to claim 1, characterized in that the air blowing nozzle (1) is provided with an incorporated air blowing duct (9) and an inlet (10) with means (11) for the connection of a hose for feeding low pressure air and that the suction air nozzle (3) is provided with a suction duct (12) and an outlet (13) with means (14) for connecting a hose for the removal of suction air.

* * * * *